US005544630A

United States Patent [19]

Koga

[11] Patent Number: 5,544,630

[45] Date of Patent: Aug. 13, 1996

[54] ALARM WHICH MAY BE USED AT THE TIME OF STARTING OF ENGINE FOR WORKING MACHINE

[75] Inventor: Hiroaki Koga, Tokyo, Japan

[73] Assignee: Kioritzt Corporation, Tokyo, Japan

[21] Appl. No.: 338,406

[22] Filed: Nov. 14, 1994

[30] Foreign Application Priority Data

Nov. 15, 1993 [JP] Japan ..... 5-065704

[51] Int. Cl.[6] ..... F02N 3/02; F02P 11/06

[52] U.S. Cl. ..... 123/185.3; 123/198 DC

[58] Field of Search ..... 123/179.5, 185.3, 123/185.2, 185.4, 198 DC, 630

[56] References Cited

U.S. PATENT DOCUMENTS

| | | | |
|---|---|---|---|
| 3,687,124 | 8/1972 | Kolorz | 123/182.1 |
| 4,382,333 | 5/1983 | Nagashima et al. | 30/381 |
| 4,682,830 | 7/1987 | Nagashima | 439/224 |
| 4,898,132 | 2/1990 | Kanno | 123/198 DC |
| 5,116,287 | 5/1992 | Hironaka et al. | 123/182.1 |
| 5,211,140 | 5/1993 | Hironaka et al. | 123/65 P |

*Primary Examiner*—Andrew M. Dolinar
*Attorney, Agent, or Firm*—Bauer & Schaffer

[57] ABSTRACT

A protruding part is provided on the outer periphery of a recoil drum and a movable member is provided to move conjointly with a slide switch S used for starting and stopping an internal combustion engine equipped with an electric spark ignition system. The protruding part contacts the movable member only when the slide switch S is moved toward the OFF-state position. A warning signal generating means is provided and is actuated when the movable member 11 contacts with the protruded part 3*a*.

1 Claim, 2 Drawing Sheets

ALARM WHICH MAY BE USED AT THE TIME OF STARTING OF ENGINE FOR WORKING MACHINE

The present invention relates to apparatus for providing an alarm at the time of starting of an internal combustion engine so as to give a warning signal when the engine stop switch is in the OFF-state (not ready for starting).

BACKGROUND OF THE INVENTION

A small sized working machine such as a chain saw, a cutting machine and the like is generally built with an air-cooled two cycle gasoline engine having a recoil starter. In actual operation, stop switch of the electric spark ignition system is first turned to its ON-state (allowing ignition) and thereafter the recoil rope of the recoil starter is pulled vigorously. As a result, a crank shaft of the engine starts to rotate and the engine starts running.

Heretofore, many times the recoil starter is operated while the stopping switch is still in the OFF-state (not allowing ignition) the user inadvertently failing to turn it to the ON-state.

In this case, even if fuel is supplied into a cylinder of the engine, no firing will occur in the cylinder because no spark is determined to the plug. If the user pulls the recoil rope several times, because the engine does not start, an excessive amount of fuel is continuously supplied into the cylinder without firing. Therefore, it is impossible to obtain proper air-fuel mixture. Further, there are many cases where engine starting becomes very difficult because of wetting of the spark plug.

The object of the present invention is to provide an alarm which at the time of starting of the engine warns the user that the engine stopping which is in OFF-state.

SUMMARY OF THE INVENTION

The alarm according to the present invention comprises a warning signal generating means which generates a warning signal at the time that the engine is started. The generating means acts by cooperation between an actuating part provided in a movable member of the engine starter and a co-acting part provided in a movable member of the engine stopping switch.

When the engine starter is operated, the actuating part provided in the movable member moves. If the engine STOP switch is in the OFF-state (for example, when the engine is intended to start,) a warning signal is generated by cooperation between the actuating part of the engine starter and the coactuating part of the engine stop switch. Thereby, an operator may know that the engine stop switch should be turned to the ON-state. Therefore, starting failure of the engine can be prevented.

DETAILED DESCRIPTION OF THE PREFERRED EMBODIMENT

Figure 2:
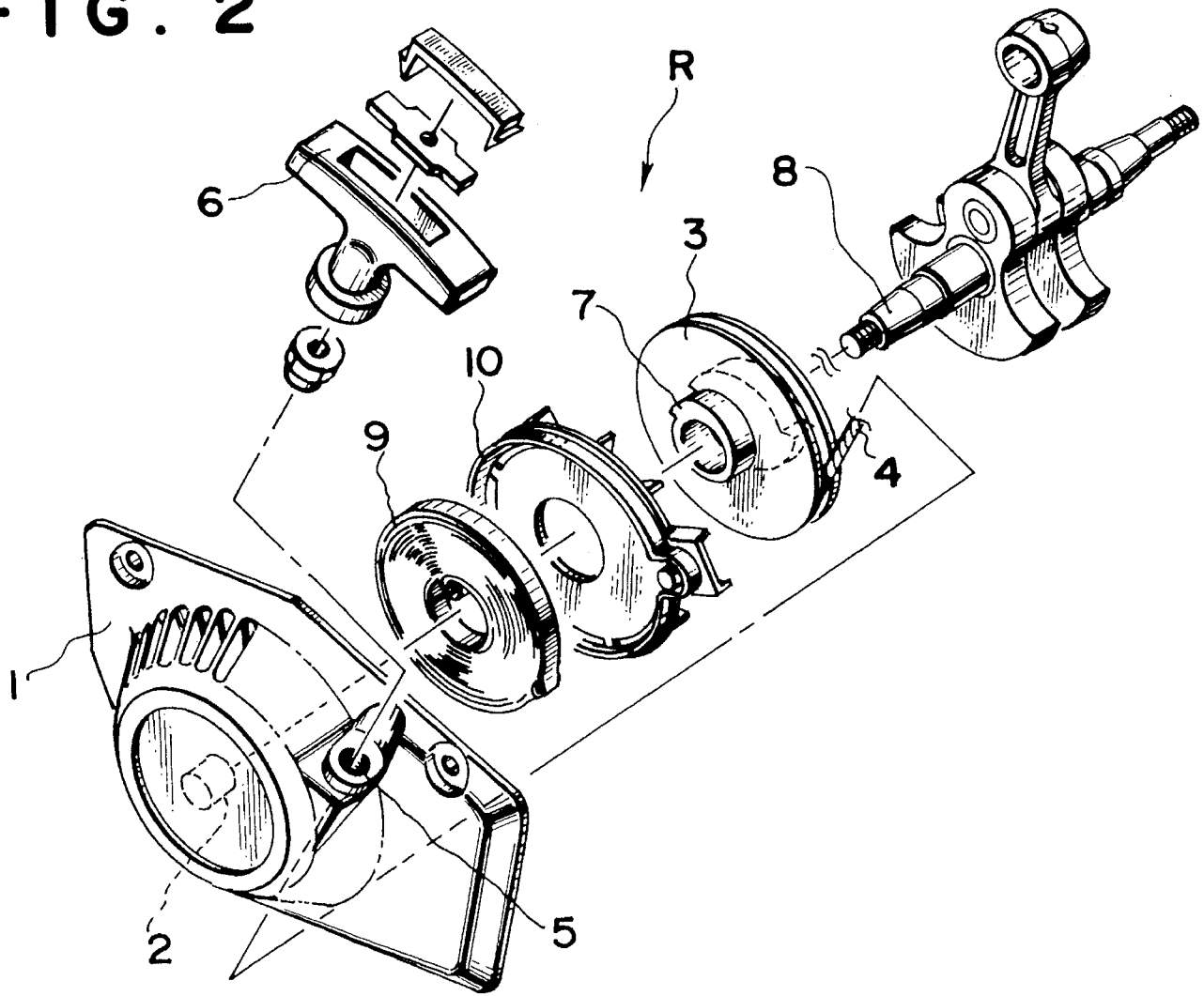
FIG. 2 is an exploded perspective view showing one example of a recoil starter for a portable working machine.

As shown in FIG. 2, a recoil starter R generally used as an engine starter for a small sized working machine has a recoil drum 3. This recoil drum is attached to a shaft 2 extending from the inner surface of a recoil cover and journalled to freely rotate around the shaft 2. In the center of the recoil drum 3, a hub 7 receiving the shaft 2, is provided so as to protrude toward the recoil cover 1.

The inner end of a recoil rope 4 is fixed about the drum 3 to be wound around the recoil drum. The outer end of the recoil rope 4 extends out from a rope outlet 5 provided on the recoil cover 1 and is connected to a handle 6.

The recoil drum 3 is connected to the crank shaft 8 of the internal combustion engine through a centrifugal ratchet (not shown) at the opposite side of the recoil cover 1.

In FIG. 2, numeral 9 is a recoil spring for returning of the recoil drum 3 and 10 is a spring holder preventing the recoil spring 9 from extending toward outside.

The present invention relates to an alarm which may be used at the time of starting of the engine for a small sized working machine having the recoil starter constructed, for example, as mentioned above.

Figure 1:
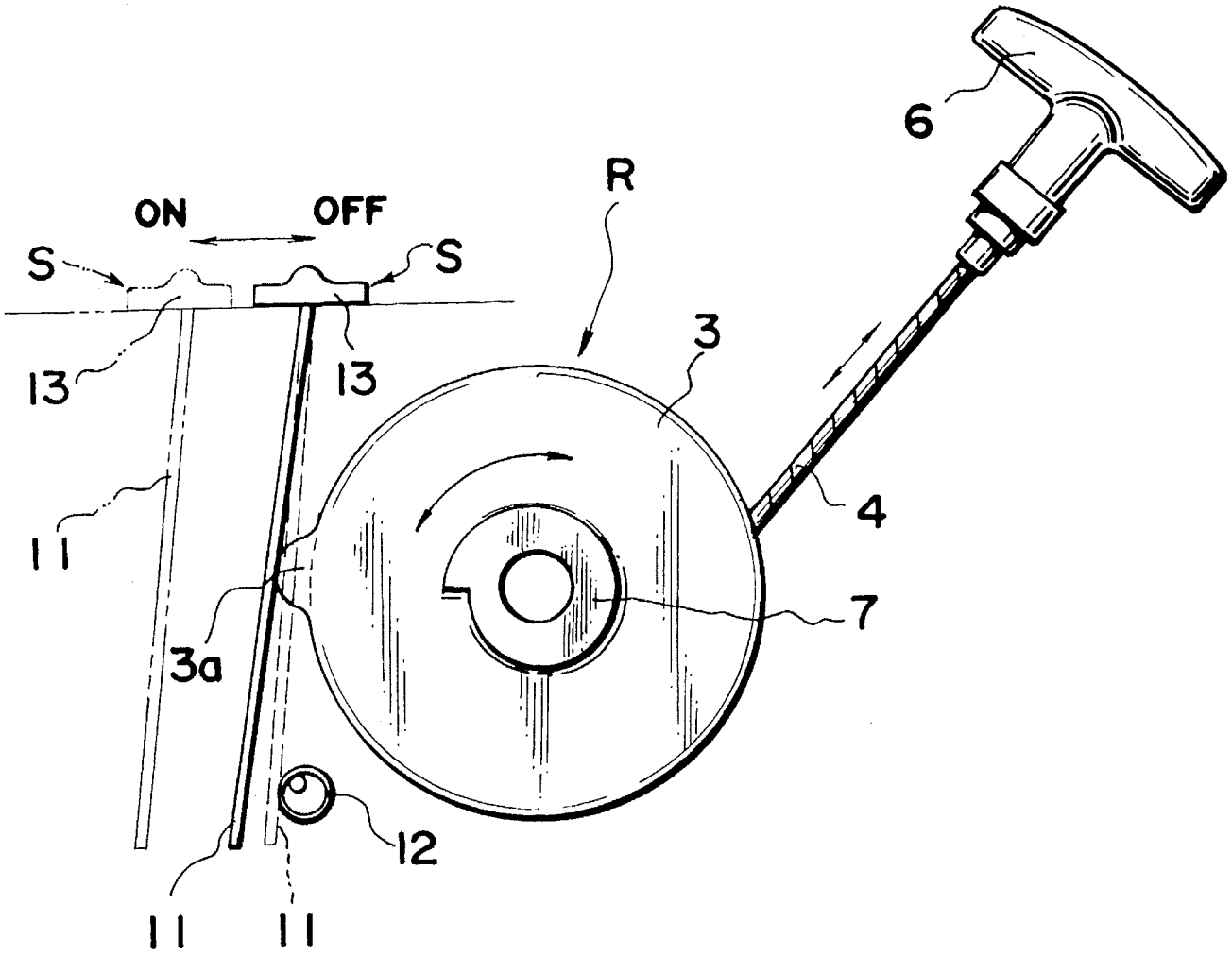
FIG. 1 is a schematic view of an alarm according to one embodiment of the present invention.

As seen in FIG. 1, a slide switch S is generally used as an engine stop switch for the working machine. The alarm shown in the drawing of this embodiment is constructed as one example, whereby the slide switch S and the recoil starter R cooperate with each other.

In FIG. 1, the slide switch S has an operation knob 13. If this knob 13 is allowed to slide away from the recoil starter R, an electric spark ignition system of the engine (not shown) is turned to ON-state and the engine is allowed to start. On the contrary, if the knob 13 is allowed to slide toward the recoil starter R, the electric system is turned to OFF-state and the engine stops.

The slide switch S is provided with a movable member 11 as a co-acting part. This movable element 11 moves together with the knob 13 when the knob 13 is moved. Preferred materials for the movable member 11 are any elastic materials such as a leaf spring and the like as shown in the drawing.

On the other hand, the recoil drum 3 of the recoil starter R is provided with a protruded part 3*a* on the outer periphery thereof as an actuating part. The recoil drum 3 acts as a movable member of the recoil starter R. The protruded part 3*a* rotates together with the recoil drum 3 when the recoil drum 3 rotates. The protruded part 3*a* may be provided in multiples. The protruded part 3*a* is formed in one body with the recoil drum 3 during molding of the recoil drum 3.

If the knob 13 of the slide switch S is moved toward the OFF-state position the movable member 11 also moves toward the recoil drum 3 at the same time. Thus, the protruding part 3*a* of the rotating recoil drum 3 intermittently touches the movable member 11. Contrarily, if the knob 13 is moved toward the ON-state position the protruding part 3*a* does not contact with the movable member 11.

A warning signal generating means is provided in which the warning signal is generated by the contact of the protruded part 3*a* with the movable member 11. This warning signal generating means comprises a sound generator 12 such as a bicycle bell, may, for example, be used. The sound generator 12 is placed near the free end of the movable member 11 when the knob 13 of the slide switch S is at the side of OFF-state.

The alarm according to this embodiment of the present invention acts as follows. The recoil drum 3 rotates when the recoil rope 4 is pulled for starting of the engine. According to the rotation of the recoil drum 3, the protruded part 3*a* also rotates.

If the slide switch S is inadvertently situated in OFF-state, the rotating protruded part 3*a* intermittently touches the movable member 11 and vibrates the movable member 11. By this vibration, the movable member 11 beats against the sound generator 12. So that the sound generator 12 generates the warning signal sound. Thus, the operator will be advised that the slide switch S of the electric system is not set in ON-state. According to the alarm of this embodiment, may be prevented from inadvertently pulling the recoil rope 4 several times even when the slide switch S is still in OFF-state and starting failure of the engine can be prevented.

Further, not only mechanical means, but also other appropriate means such as a lamp or a buzzer which operated by sensing the movement of the movable member 11 may be used.

The alarm according to the present invention can also be applied to the engine starter using an electric motor.

I claim:

1. An alarm system for an internal combustion engine equipped with an electric spark ignition system comprising a protruding part located on the outer periphery of a recoil drum, a movable member provided so as to move conjointly with a slide switch for starting and stopping the engine, said movable member contacting with said protruding part only when said slide switch is moved toward the OFF-state position to stop the engine, and warning signal generating means for generating a warning signal when said movable member contacts with said protruding part.

* * * * *